US006923271B2

(12) United States Patent
Frauhammer et al.

(10) Patent No.: US 6,923,271 B2
(45) Date of Patent: Aug. 2, 2005

(54) HAND POWER TOOL

(75) Inventors: Karl Frauhammer, Leinfelden-Echterdingen (DE); Gerhard Meixner, Filderstadt (DE); Heinz Schnerring, Dettenhausen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/264,226

(22) Filed: Oct. 2, 2002

(65) Prior Publication Data

US 2003/0098168 A1 May 29, 2003

(30) Foreign Application Priority Data

Nov. 24, 2001 (DE) ..... 101 57 831

(51) Int. Cl.[7] ..... E02D 7/06

(52) U.S. Cl. ..... 173/132; 173/93; 173/48; 173/128; 173/178; 408/238; 408/239 A; 408/239 R

(58) Field of Search ..... 173/93, 48, 128, 173/132, 178, 109; 279/62, 75; 408/239 A, 240, 238, 239 R

(56) References Cited

U.S. PATENT DOCUMENTS

| | | | | |
|---|---|---|---|---|
| 4,719,976 A | | 1/1988 | Bleicher et al. | |
| 5,346,023 A | | 9/1994 | Takagi et al. | |
| 5,775,441 A | * | 7/1998 | Sakuragi et al. | 173/200 |
| 6,457,535 B1 | * | 10/2002 | Tanaka | 173/178 |
| 6,691,796 B1 | * | 2/2004 | Wu | 173/48 |

FOREIGN PATENT DOCUMENTS

| | | |
|---|---|---|
| GB | 1 505 907 | 4/1978 |

* cited by examiner

*Primary Examiner*—John Sipos
*Assistant Examiner*—Michelle Lopez
(74) *Attorney, Agent, or Firm*—Michael J. Striker

(57) ABSTRACT

A hand power tool has a tool, a hammer tube, a striking mechanism with a striker and an anvil with an integrated receptacle for the tool which is strikingly drivable in the receptacle, a blocking element connecting the tool and the anvil in an axial direction, and a toothing that connects the anvil with the hammer tube displaceably in an axial direction.

2 Claims, 2 Drawing Sheets

HAND POWER TOOL

BACKGROUND OF THE INVENTION

The present invention relates generally to hand power tools.

Drill hammers and impact hammers with a striking mechanism are known, which have a striker and an anvil with an integrated receptacle for a tool. The anvil which is supported in a hammer tube and is driven rotatably has an inner hexagon in the receptacle. The tool is connected with the anvil in the receptacle via the inner hexagon in a form-locking manner in a peripheral direction and is rotatably driven by it. In the axial direction the tool is secured in a housing-fixed tool receptacle via a transverse pin which is arranged at an end facing in a machining direction before the anvil.

SUMMARY OF THE INVENTION

Accordingly, it is an object of the present invention to provide a hand power tool, in particular a drilling hammer and/or chiseling hammer, which is a further improvement of the existing hand power tools.

More particularly, it is an object of the present invention to provide a hand power tool, in particular a drilling hammer and/or a chiseling hammer, with a hammer tube and a striking mechanism which has a striker and an anvil with an integrated receptacle for a tool which is strikingly drivable in the receptacle.

It is proposed to connect the tool and the anvil in an axial direction via at least one blocking element. The tool can be supported exclusively in the receptacle, and a compact device is obtained, in which the mounting space, components, weight, mounting expenses and costs can be saved. Furthermore, relative movements between the receptacle and the tool can be advantageously reduced, and wear in the receptacle region of the tool can be decreased.

When in accordance with the present invention, the hammer tube, the anvil and the tool are connected via the blocking element, a movement in the peripheral direction between the hammer tube, the anvil and the tool can be advantageously avoided. An axial movement of the tool in the receptacle can be maintained small, and a wear of the receptacle element, in particular the drive teeth on the anvil, can be reduced. The service life of the hand power tool can be increased, and the cost, in particular maintenance cost, can be reduced.

The hammer tube can be formed as a one piece element or as a multi-part element. When the hammer tube is formed as a one-piece element, and the hammer tube surrounds the anvil in the region of the receptacle radially, the hammer tube in the overlapping region can be used as a guide in a structurally simple manner and the components, the mounting space as well as the weight can be saved.

In a further embodiment of the invention, it is proposed that the blocking element in its position is arranged in a radial receptacles of the hammer tube, the anvil and the tool. A constructively simpler locking mechanism of the tool can be therefore realized in an especially compact structural manner. Available components, such as for example the blocking element, can perform several functions. The blocking element can be used for rotary driving and simultaneously as a securing element for the tool in an axial direction. Additional components can be avoided and the structural space as well as manufacturing cost can be spared.

When the blocking element is formed as a ball, then an arrangement is obtained, in which clamping of the blocking element is avoided in a simple manner and a secure blocking and unblocking of the tool in the anvil can be always guaranteed. It is to be understood that other blocking elements can be also considered by a person skilled in the art, for example sliding blocks, rollers, etc.

The blocking elements can be guided manually via an actuating element or automatically or partially automatically in there blocking and/or their unblocking positions.

Advantageously the anvil is non rotatably connected with the hammer tube through a toothing. A rotation entrainment can be obtained through a large transmission surface so as to transmit great forces. The individual components can be further simplified and their respective functions can be realized. The toothing can be provided exclusively for transmission of the rotation from the hammer tube to the anvil, and the blocking element can be provided exclusively for axial securing of the tool in the anvil.

Further it is proposed that the toothing be arranged opposite to the machining direction after the receptacle on the anvil. The toothing can be arranged preferably protected from dust and the mounting space can be advantageously utilized in the rear region over the anvil.

The anvil can be secured in the machining direction via a releasable safety element. With this construction a device is provided in which the anvil can be exchanged simply, and a complete dismounting of the hand power tool can be advantageously avoided. Mounting time and mounting costs can be reduced.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
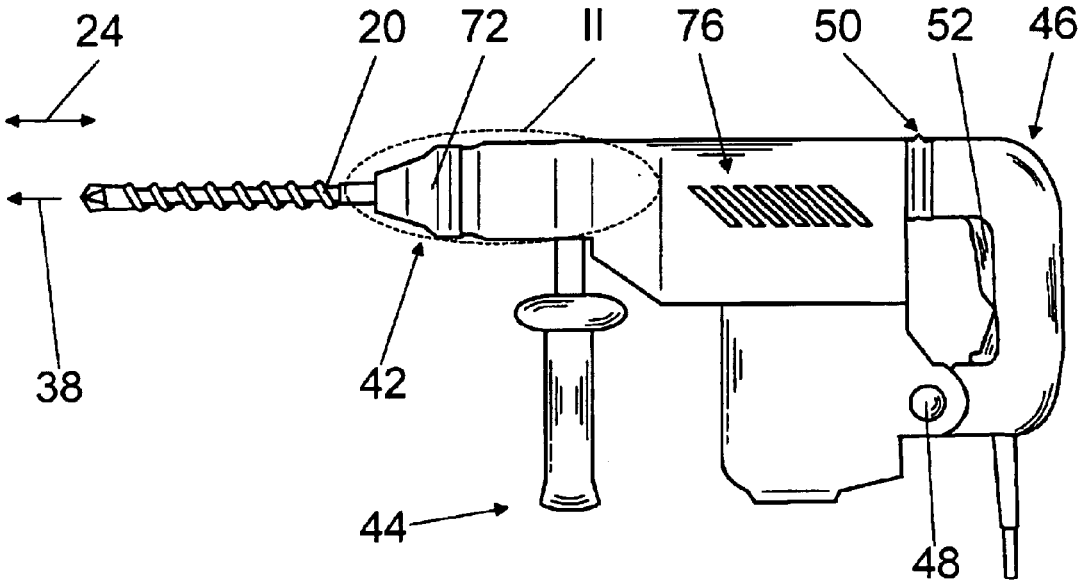
FIG. 1 is a view schematically showing a hand power tool formed as a drill hammer in accordance with the present invention.

FIG. 1 shows a drill hammer which has a not shown electric motor as well as a transmission accommodated in a housing 76. The housing also accommodates a striking mechanism 12 for rotatably and strikingly driving a tool 20 or a drill mounted in a tool holder 42 as shown in FIG. 2.

A first handle 44 is mounted on the housing 76 in a direction opposite to the machining direction 38 after the tool holder 42. It extends transversely to the machining direction 38. A second bracket-shaped handle 46 is arranged at the side of the housing 76 which faces away from the tool 20. It also extends transversely to the machining direction 38. The second handle 46 at its first end which faces away from a tool axis is connected with the housing 76 through a pivot 48 with a pivot axis extending transversely to the machining direction 38. At a second end, the handle 46 is connected with the housing 76 through an isolating device 50. An actuation switch 52 is arranged on the handle 46 and formed as a switching rocker.

Figure 2:
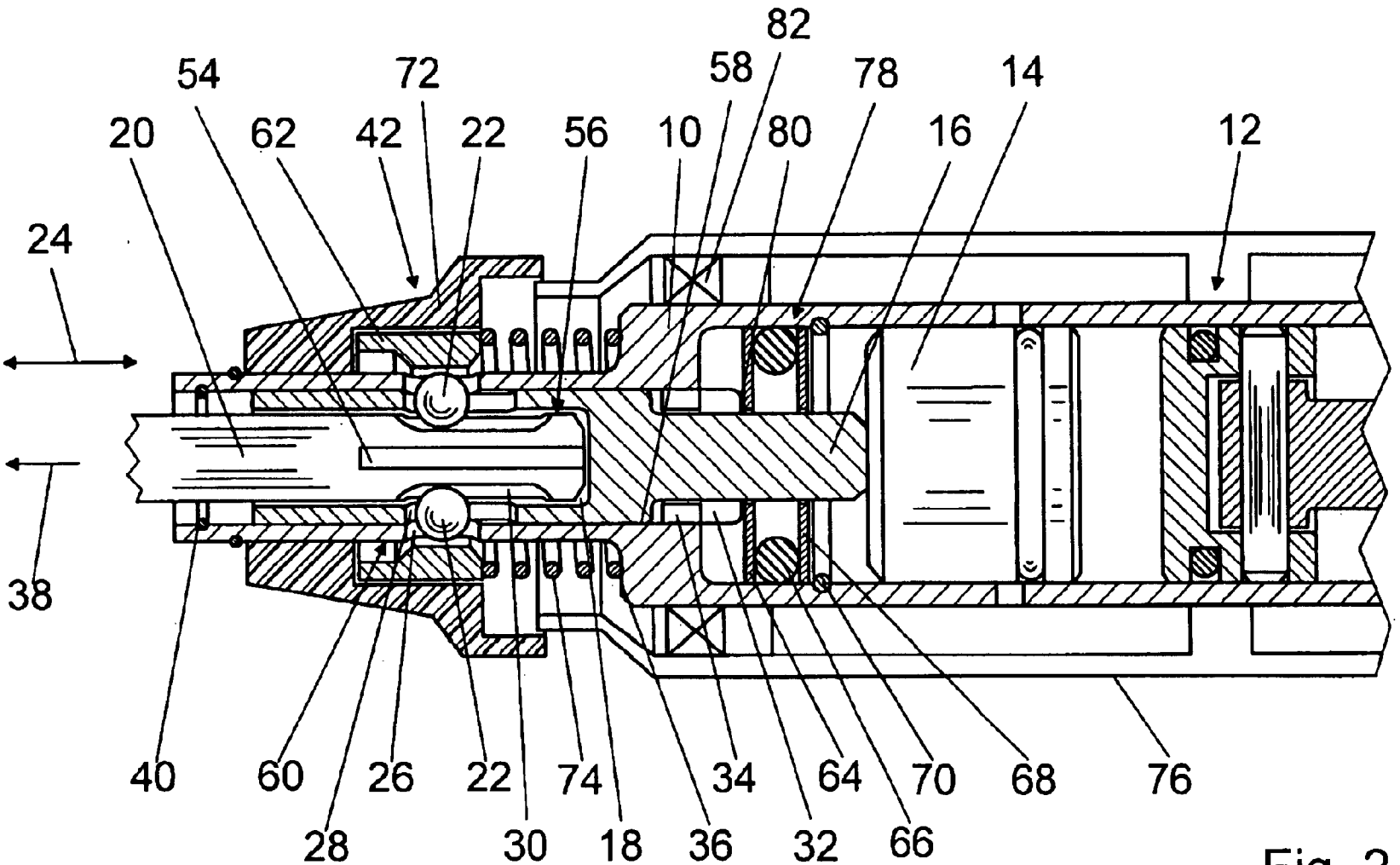
FIG. 2 is a view showing a longitudinal section through the drill hammer of FIG. 1, taken in an area II.

The striking mechanism 12 has a striker 14 and an anvil 16 with an integrated receptacle 18 for the tool 20 as shown in FIG. 2. The tool 20 is secured in the anvil 16 via two blocking elements 22, 22' in an axial direction 24, or is connected with the anvil 16. The tool 20 is supported exclusively in the receptacle 18 and is drivable through the striking mechanism 12 in a striking manner. On an inner side of the receptacle 18 two driver teeth are formed on the anvil 16. They are form-lockingly engaged in two corresponding grooves 54 which are formed on a tool shaft 56. The tool 20 is fixed in the receptacle 18 or in the anvil 16 in the peripheral direction.

The anvil 16 is radially surrounded by a hammer tube 10 in the region of the receptacle 18. The hammer tube 10 is supported rotatably via a front roller bearing 82 and a rear not shown roller bearing in the housing 76. The tool 20, the anvil 16 and the hammer tube 10 are connected with one another in an axial direction 24 and in a peripheral direction via blocking lements 22, 22' formed as balls, as shown in FIG. 2. The blocking elements 22, 22' are arranged in their blocking positions in radial recesses 26, 28, 30 of the hammer tube 10, the anvil 16 and the tool 20, which are located over one another in the radial direction. The blocking element 22, 22' are held radially outwardly in their blocking position via holding ring 62.

The anvil 16 which is supported in the hammer tube 10 displaceably in the axial direction 24 is non-rotatably connected with the hammer tube 10 in the peripheral direction via a toothing 32, 34. The toothing 32 formed by a set of outer teeth is arranged, opposite to the machining direction 38, after the receptacle 18 on the anvil 16. A toothing 34 which corresponds to the toothing 32 is formed on an inner side 58 of the hammer tube 10. The bearing region 60 supports the anvil 16 displaceably in an axial direction 24 and radially surrounds the anvil 16 in the region of the receptacle 18. The hammer tube 10 is drivable through a not shown toothed wheel which is non rotatably supported on the hammer tube 10. The torque and the rotary movements are transmitted from the hammer tube 10 through the toothings 32, 34 to the anvil 16, and from the anvil 16 through the driver teeth of the anvil 16 and the grooves 54 to the tool 20.

The anvil 16 is secured in the machining direction 38 via a releasable securing element 40 formed as a spring ring. It is supported in its operational position via a damping unit 78 and via a spring ring 70 on an inner periphery of the hammer tube 10. The damping unit 78 is provided at a side facing the tool 20 with a first metal disc 64 having a central receptacle, a ribber ring 66, and at a side which faces away from the tool 20 with a second metal disc 68 having a central receptacle. The anvil 16 is supported opposite to the machining direction 38 by a step 80 on the first metal disc 64, and the second metal disc 64 is supported opposite to the machining direction 38 against the spring ring 70.

In order to exchange the tool 20 and/or to exchange the anvil 16, an operator displaces, through a sleeve 72 of the tool holder 42, the holding ring 62 opposite to the machining direction 38 against a spring force of the spring element 74. The spring element 74 acts with its first end which faces in the machining direction 38, against the holding ring 62 and is supported with its second end which faces away from the machining direction 38 on a radial outwardly facing collar 36 of the hammer tube.

The holding ring 62 releases the blocking elements 22, 22' radially outwardly and the blocking elements 22, 22' can move radially outwardly during the removal and insertion of the tool 20. For removing the anvil 16, the securing element 40 which is formed as a spring ring is loosened, and the anvil 16 is removable in the machining direction 38.

It will be understood that each of the elements described above, or two or more together, may also find a useful application in other types of constructions differing from the types described above.

While the invention has been illustrated and described as embodied in hand power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hand power tool, comprising a tool;

a hammer tube; a striking mechanism having a striker and an anvil with an integrated receptacle for said tool which is strikingly drivable in said receptacle; a blocking element which connects said tool and said anvil in an axial direction; a first toothing with axial grooves formed on an inner side of said hammer tube; and a second toothing corresponding to the first toothing formed by a set of outer teeth on said anvil, wherein said anvil being connected non-rotatably and displaceably in axial direction with said hammer tube via engagement of said first toothing with said second toothing.

2. A hand power tool as defined in claim 1, wherein said second toothing is arranged, opposite to a machining direction, after said receptacle on said anvil.

* * * * *